United States Patent [19]

Fuller

[11] Patent Number: 4,813,605

[45] Date of Patent: Mar. 21, 1989

[54] FLUID FLOW SYSTEM

[76] Inventor: Frank J. Fuller, 11133 Encino Ave., Granada Hills, Calif. 91344

[21] Appl. No.: 31,607

[22] Filed: Mar. 30, 1987

[51] Int. Cl.[4] ..... B05B 3/08

[52] U.S. Cl. ..... 239/233; 239/251; 239/513; 239/533.1; 239/582.1

[58] Field of Search ..... 239/230, 231, 232, 233, 239/251, 252, 259, 513, 581.2, 582.1, DIG. 1, 76, 533.1

[56] References Cited

U.S. PATENT DOCUMENTS

| | | | |
|---|---|---|---|
| 1,491,253 | 4/1924 | Barnes | 239/231 |
| 1,712,523 | 5/1929 | Schneider | 239/233 |
| 2,021,710 | 11/1935 | Wilson | 239/231 |
| 2,310,796 | 2/1943 | Lappin | 239/231 |
| 2,625,411 | 1/1953 | Unger | 239/233 |
| 2,733,958 | 2/1956 | Warren | 239/231 |
| 2,850,326 | 9/1958 | Kofford | 239/513 |
| 2,895,681 | 7/1959 | Kachergis | 239/230 |
| 2,943,798 | 7/1960 | Rienks | 239/DIG. 1 |
| 3,017,123 | 1/1962 | Rinkewich et al. | 239/233 |
| 3,563,465 | 2/1971 | Foreman | 239/233 |
| 3,664,586 | 5/1972 | Harris, Sr. | 239/233 |
| 3,979,066 | 9/1976 | Fortner | 239/252 |
| 4,154,404 | 5/1979 | Clawson | 239/DIG. 1 |
| 4,195,782 | 4/1980 | Troup | 239/230 |
| 4,611,760 | 9/1986 | Koresch | 239/233 |
| 4,669,663 | 6/1987 | Meyer | 239/233 |

FOREIGN PATENT DOCUMENTS

| | | | |
|---|---|---|---|
| 1129339 | 5/1962 | Fed. Rep. of Germany | 239/233 |
| 595632 | 7/1959 | Italy | 239/233 |

*Primary Examiner*—Andres Kashnikow
*Assistant Examiner*—Michael J. Forman
*Attorney, Agent, or Firm*—Albert O. Cota

[57] ABSTRACT

A system which has a body (20) with internal pasageways and a hollow connecting sleeve (24) attached thereto. A hollow union (32) is rotatably retained on the sleeve (24) and a gasket (30) provides a seal therebetween. A pair of adjustable arm stops (34) attach to the union (32) confining the rotational movement. A nozzle (36) is joined to the body (20) with an arm (42) distending parallel with the nozzle (36) and a pivotal member (44) extends upwardly therefrom. A plate (46) is swivelly mounted on the member (44) with means to limit the pivotal movement connected to the arm (42). The fluid from the nozzle (36) impinges on the plate producing unequal torque on opposed sides of the plate (46) as it pivots upon the member (44) causing the entire arm (42) to axially advance. In the reversing embodiment a torque differential and flow impingement upon the stop (34) combine energy functions and reversers. Finally, a system which nominally distributes precipitation density as the square of the radial distance between zero range and maximum range.

19 Claims, 5 Drawing Sheets

15
76
44
46
74
80
84
88
86
36
34
15
78
86
64
20
84
88
42
66
24
34
66
32
19
92
98
94
96
19
32
24
68
68
70
70
92
98
94
96

46
76
74
78
86
42
44
90
80
84

34
72

78
80
46
82
82
42

68
70

FLUID FLOW SYSTEM

CROSS REFERENCE TO RELATED APPLICATION

This application is a continuation-in-part of application Ser. No. PCT/US85/02497 filed Dec. 16, 1985 now abandoned.

TECHNICAL FIELD

The present invention relates to flat plate distribution of liquids in general such as water irrigation of fields and lawns. This invention embraces both non-reversing and reversing fluid flow systems. As utilized herein the term fluid flow embraces gas, fluid, and fine granular flow systems where granular dimensions are small with respect to the flow passageways. In particular this invention relates to steady rotation systems as opposed to step by step pulse impact rotation systems.

BACKGROUND ART

Previously, many types of sprinklers have been used to endeavor to provide an effective means for automatically dispensing a flow of water over a given area. Some are fixed and do not rotate, but create a given pattern, while others rotate by the action of a cam follower pivoted into engagement with the flow stream creating the motivating force. A search of the prior art did not disclose any patents that read directly on the claims of the instant invention, however, the following U.S. patents were considered related:

| U.S. PAT. NO. | INVENTOR | ISSUED |
|---|---|---|
| 4,462,545 | Lourenco | 31 July 1984 |
| 4,281,793 | DeWitt | 4 August 1981 |
| 3,884,416 | King | 20 May 1975 |
| 2,739,839 | Greener, et al | 27 March 1956 |
| 2,600,987 | Gallice | 17 June 1952 |
| 1,712,523 | Schneider | 14 May 1929 |
| 595,632 | Marchi (Italy) | 2 July 1959 |

Lourenco teaches a spindle having a cam rotatable with the sprinkler head mounted on an upper chamber. A cam follower is pivoted into engagement with the cam by means of hydraulic pressure. A valve key portion constricts the flow of water in a variable manner controlled by the shape of the cam achieving a pattern, such as a square or non-circular configurations.

DeWitt utilizes a vertical axis water sprinkler having an internal control shell rotating a spray head within a fixed housing. The spray pattern is governed by a number of pattern defining plates. An aperture sweeps across the face and edge of the plate rotating the housing in a predetermined manner. Speed is held constant despite changes in output by a friction bearing and shell pressures.

King employs a rotating sprinkler head with a hollow shaft having a restricting port. A port plate has two passageways with a central port aligned with the axis of rotation and another offset therefrom. An orifice plate is held in place by a spring. As the device rotates, the radial reach is varied depending upon the mutual overlap between orifices and ports achieving a square irrigation pattern.

Greener et al applies a fixed sleeve member supported to a body member. A tubular axle is mounted within the sleeve and is restrained against longitudinal movement. The axle has a continuous inlet and auxiliary inlets at prepositioned locations. The device is attached between the water source and a conventional sprinkler head to vary the amount of water at various angular positions in a rotational cycle, thereby creating a predetermined pattern of distribution.

Gallice also provides a device that is connected between the water source and a revolving sprinkler head. This invention also varies the flow to create a predetermined flow pattern.

Schneider teaches steady as opposed to impact rotation with a deflector pivot point near the output end of a hollow flow arm. The deflector butt section inside the arm has a lower moment of inertia than that of the apex section. The butt section has less flow contact area than the flow cross section area to permit butt swivel action. Arm rotation depends on flow pressure force to hold the deflector at a butt stop position. Rotation reversal requires arm contact with an arm stop and sufficient kinetic energy in the apex section so as to swivel the deflector to an opposite butt stop.

The Italian patent issued to Marchi (Montrouge Meter Manufacturing and Gas Works Company, France) discloses a sprinkler having a wedge shaped deflector with the apex moment of inertia nominally equal to the butt moment of inertia. The jet of water hits the deflector causing the swing arm to rock, shifting the arm on the shaft and producing in conjunction with a spring loaded element, step by step impact rotation.

DISCLOSURE OF THE INVENTION

Since the prior art has been concerned with sprinklers in general that create a flow pattern of various shapes and sizes, little has been done to simplify the basic pulsating sprinkler. Many and varied applications utilize a pulsating head sprinkler system to irrigate crops and lawns, and the need has been long felt to have a system that may replace the basic concept of pulsating sprinklers while still allowing the pattern to be controlled.

The primary object of this invention is rotation and desirable dispersal of a flowing liquid as it impacts a torque dispersal plate. In the reversing embodiment the torque dispersal plate is free to rotate within limits and the flow path of the fluid is directed to the fore and/or aft ends. Using only one rotating member in the entire system, the number of components is reduced. This simplicity of design eliminates many hinged, or movable components and relies upon a simple, single plate to accomplish the entire motivational and dispersal system in both reversal and non-reversal embodiments. The principles of this system may be used in other areas and is not limited to this application only.

An important object of the invention eliminates the use of a hammer type device that repeatedly impinges onto the flowpath creating a rapidly interrupted sound that is repetitious and annoying.

Another object of the invention is cost reduction because of the radical reduction in the number of components, manufacturing costs are reduced, reliability is improved and operational use is simplified.

Still another object of the invention allows the directional flow and fan pattern to be governed in its intensity and path. Reversers limit angular coverage while swivel stops modify the fan pattern. The type of surface on the torque dispersal plate controls the granular size of the water droplets sprayed into the pattern and further effects the proportional impact between fore and aft sections of the plate. Since the operation is simple to understand, the adjustment is easily and intuitively perceived. A detailed operating and adjusting procedure is unnecessary.

Yet another object provides a simplified non-reversing embodiment that is even more cost effective as it eliminates still more elements and yet produces an adjustable flowpath in a circular pattern.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figures 1, 2, 3:
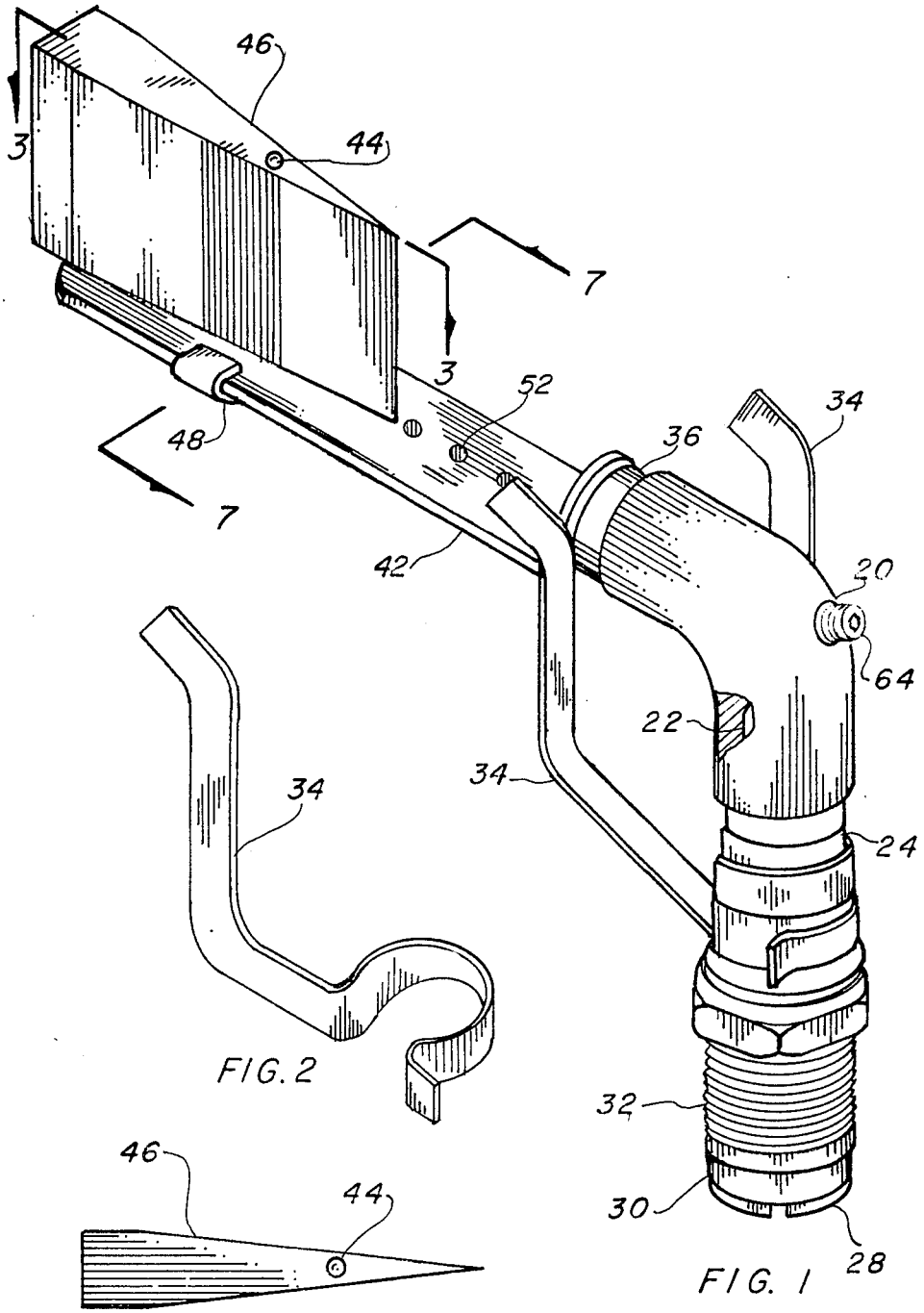
FIG. 1 is a partial isometric view of the preferred embodiment with an adjustable clamp and fixed arm.
FIG. 2 is a partial isometric view of the directional shifter completely removed from the invention for clarity.
FIG. 3 is a plan view of the preferred embodiment taken along lines 3—3 of FIG. 1.

The best mode for carrying out the invention is presented in terms of a preferred embodiment, a second embodiment and a third embodiment. FIG. 1 illustrates the preferred embodiment, which consists of an angular body 20 having an internal passageway on the inside from one end through to the other. The body 20 further contains connecting means 22 on the inlet, and the outlet in the form of threads or sockets for connection by threading, thermoplastic bonding, or the like. The body 20 functions as a conduit for transmitting fluid within.

A hollow, straight connecting sleeve 24 having connecting means 26 on one end and a flange 28 with a gasket 30 positioned on the sleeve contiguous with its inside surface on the other end, is connected to the inlet of the body 20. This sleeve 24 extends the body 20, creating a straight tubular section between the body 20 and the flange 28.

A hollow union 32 having a method of attachment on the outside of one end and a plurality of grooves on the other with flats therebetween is rotatably retained upon the straight section of the sleeve 24. This ability to rotate allows the assembly to create a hydraulic seal between the flange 28 and the end of the union 32, having the gasket 30 positioned sealably therebetween. With this arrangement, the body 20 and sleeve 24 are free to rotate when the union 32 is attached to a liquid supply line as normally found in an irrigation system as an example.

A pair of reversers 34 intimately embrace the grooves on the union 32 and project outwardly distal to the outlet of the body 20. The first shifter 34 is on one side of the body and the second shifter 34 is on the other side, tangentially aligned therewith, thereby confining the rotational movement of the body 20 in relation to the union 32. The reversers 34 in the preferred embodiment, are comprised of a metallic sheet ribbon formed to include a retaining loop on one end and an angular flange on the other. This loop intimately embraces the groove on the union 32, allowing adjustment of the reversers limiting the rotational travel of the body 20 in relation to the union 32. Another embodiment, as shown in FIG. 6, is formed from round wire in the same basic shape, except the groove in the union is radial forming a pocket to receive the wireform retaining loop.

Figures 4, 5, 6:
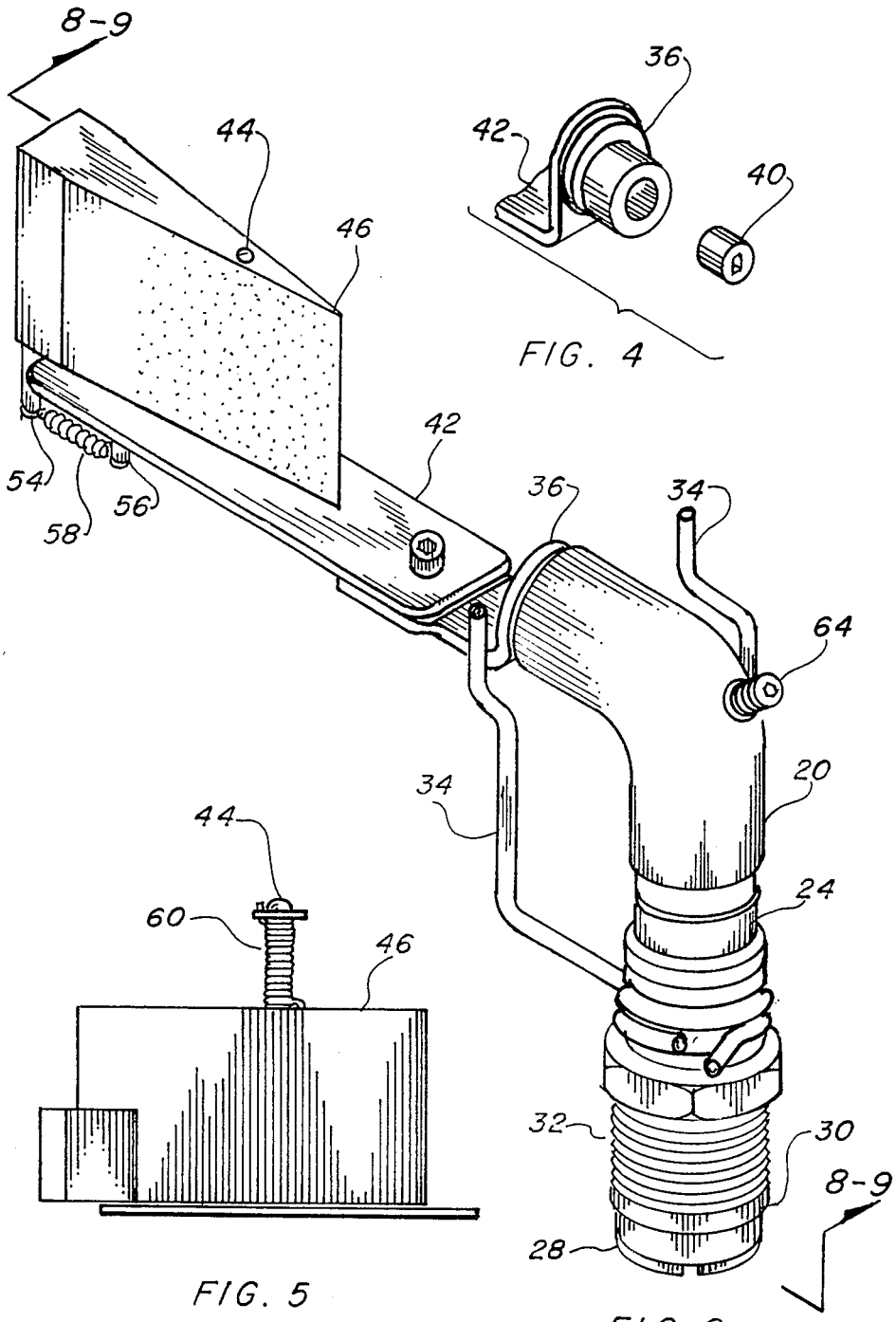
FIG. 4 is a partial isometric view of the separate orifice within the nozzle means completely removed from the invention for clarity.
FIG. 5 is a partial elevational view of the preferred embodiment illustrating the torque dispersal plate with the torsion spring plate stop means.
FIG. 6 is a partial isometric view of the preferred embodiment with an adjustable arm and spring loaded plate stop means.
Figure 9:
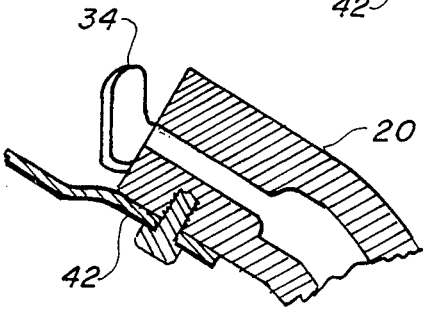
FIG. 9 is a partial cross-sectional view taken along line 9—9 of FIG. 6.
Figure 8:
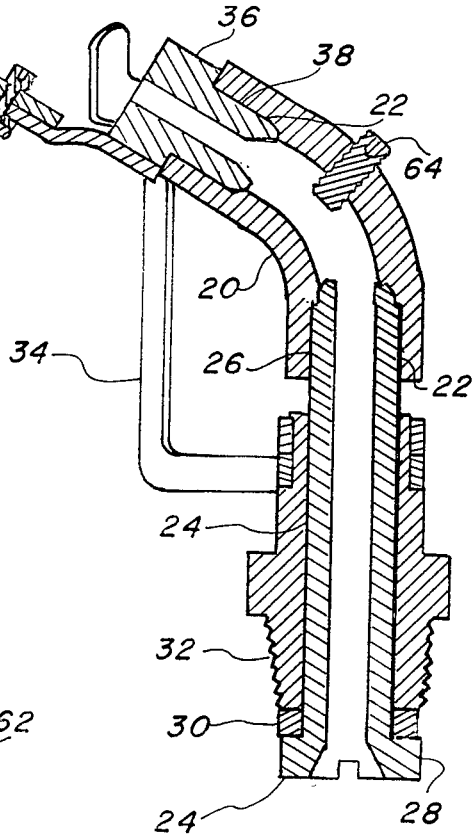
FIG. 8 is a cross-sectional view taken along lines 8—8 of FIG. 6.

Nozzle means 36 having a first and second end such as threads, brazing, press fit, structural adhesive or the like, as shown in FIGS. 4 and 8 are connected on the first end to the body 20 with attaching means 38. This nozzle 36 is shown best in FIG. 4 completely removed from the invention and in cross-section in FIG. 8. The second end defines an orifice through which the fluid passes. The nozzle 36 may also be integral with the body 20 with a portion of the outlet end defining an orifice through which the fluid passes as best illustrated in FIG. 9.

In another embodiment, also depicted in FIG. 4, a separate orifice 40 having a specific internal shape is disposed within the nozzle 36 and allows the fluid flow field to disperse in a fan or other specific pattern. The connection means between the orifice 40 and the nozzle 36 is also optional, such as threads, press fit, or epoxy bonding. As also shown in FIG. 4, an arm 42 is permanently affixed to the nozzle 36 and angularly projects from the second nozzle end. This arm 42 has an upwardly extending pivotal member 44, in parallel alignment with the orifice. The arm 42 may be flat on both sides or may be radial on the underside and flat on the top, or any other convenient shape or configuration. The arm 42 may be in a single unitary form, such as depicted in FIG. 1, or may be made in two adjustably connected pieces attached together with a threaded fastener, or the like, allowing angular alignment. This embodiment is shown in FIGS. 6 and 8. Another embodiment is shown in FIG. 9 wherein the arm 42 is permanently connected to the outlet end of the body 20 with a threaded fastener or the like. The arm 42 may also be attached to the connecting sleeve 24.

Figure 10:
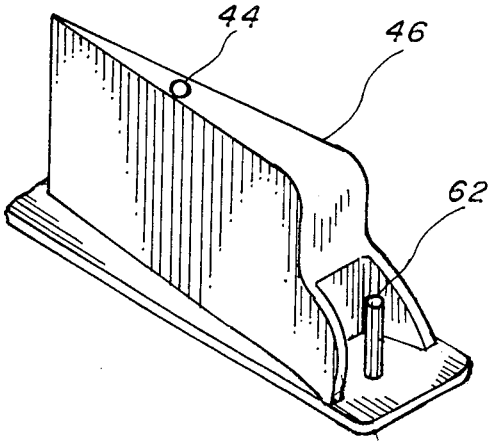
FIG. 10 is a fragmentary isometric view of the torque dispersal plate with the peg stop means.

A torque dispersal plate 46 shown in FIGS. 1, 6 and 8 having a fore end and an aft end, is disposed upon the pivotal member 44 in a swivel manner. The fore end is in front of the member 44 and the aft end is located therebehind. This plate 46 intercepts the flow of fluid from the nozzle 36 and changes the flow direction and disperses the flowpath into a fan-like pattern. One end of the plate 46, with respect to its interface with the pivotal member, has a greater length and mass than the other end, the greater length and mass being on the aft end. A roughened surface on each side parallel to the pivotal member 44 creates frictional backup of fluid upon the surface when a flow of fluid is impinged thereupon. This fluid backing ensures greater fluid impact force on the fore plate because the plate seeks a center position rather than a plate stop position. Further, at least one or both sides may be altered to create changes in torque and flow fan pattern when fluid is impinged thereon. This change may be in the altered form of grooves, as depicted in FIG. 1 or etched, latticed, sandblasted, stippled, cut knurled, or the like. FIG. 5 illustrates another embodiment of the plate 46 with the addition of a member to flare the aft end wider to produce an increased amount of aft end torque on the plate 46 when a fluid is impinged on the surface. This reduces the amount of force to swivel the plate as explained later herein. FIGS. 8 and 10 also depict yet another embodiment with an integral flare for the same objective, the configuration deviates slightly, indicating that the principles remain constant, but the shapes may vary and still remain within the scope of the invention.

Figure 7:
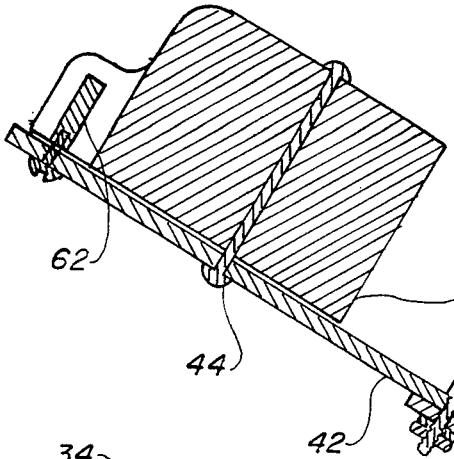
FIG. 7 is a cross-sectional view taken along lines 7—7 of FIG. 1.
Figure 7:
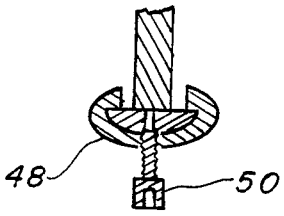

In order to limit the swivel travel of the torque dispersal plate 46, plate stop means are utilized and are attached in some manner to the arm 42 within fixed limits. Of many possibilities two plate stop means are illustrated pictorially in FIGS. 1 and 7. One embodiment includes a sliding adjustable "C" shaped clamp 48 engaging two sides of the arm 42 creating an interference with the movement of the plate 46. Adjustment is made by loosening a fastener 50 on the underside of the clamp and sliding the desired direction and retightening.

Another stop reversal means is depicted in FIGS. 8 and 10 and utilizes a stop 62 mounted upon the arm 42 between the end and the pivotal member 44 engaging a hollow surface between the flare ends of the plate 46, thereby limiting the rotational capabilities to a given arc governed by the configuration of the plate 46 and location of the stop 62 in relation to the member 44.

Springs 58 or 60 may be used in conjunction with the above plate stop means. They are not only stop means but also tension means that function to limit the impact of the plate striking the swivel stop thereby preventing undesirable oscillations of the plate about the pivotal member. Another purpose of such springs is that they return the torque plate 46 to near midposition between the stops when fluid flow is turned off, thereby eliminating the possibility of "hangup" on the reverser arm upon system startup.

FIGS. 1, 6, 8 and 13 illustrate the addition of a flow restrictor 64 which is adjustably secured within the body 20. This restrictor consists of a threaded screw, or the like, with one end having either a flat or pointed end and the other, means to make an adjustment, such as a hexagonal socket. This restrictor 64 functions to limit the amount of fluid that flows within each system when more than one is used simultaneously. This compensates for the line losses in the pipes connected in between, allowing all of the systems to utilize the same volume of flow. Adjustment is made from the outside and the amount of penetration governs the restriction.

A series of countersunk holes 52 may be included in the arm 42 to adjust the pivotal member 44 along the arm 42. A preferred method not illustrated is incorporation of pivot member 44 on a plate which by means of a friction clamp may be adjusted along the arm 42 as desired.

In operation, the apparatus is connected by the union 32 to a coupling on a conventional water pipe or a portable base commercially available for a sprinkler head.

When energized, assuming a near neutral position of plate 46, the fluid flow leaves the nozzle 36 and impacts first upon the fore section of plate 46, and then makes contact with the aft sections of plate 46. The impact force between the fluid flow and the fore section of plate 46 causes a change in fluid flow direction thereby causing a relatively large swivel torque of plate 46 about the pivotal member 44. As the fluid flow contacts the aft section of plate 46, an opposed but smaller swivel torque occurs in the aft section of plate 46 about the pivotal member 44. This smaller aft plate turning torque is due to the fact that most of the fluid flow direction change occurs in the fore section of plate 46.

As a result, plate 46 is driven into pressure contact with one of its stop members 48. The resultant turning torque in arm 42 causes the arm to rotate until the body 20 or nozzle 36 is arrested by reverser 34. At this point the kinetic energy stored in plate 46 as a result of its rotational travel on the arm 42 causes plate 46, because of the greater mass and length of its aft section, as compared to its fore section, to swivel to its opposite swivel stop 48. This reversal of plate 46 between its two stop positions results in automatic rotational reversal of arm 42 and the fluid flow.

In addition to the above function, a reversal force is concurrently provided because the reverser 34 protrudes into the water flow out of the nozzle 36 so as to change momentarily, the direction of the flow at the reverser position. Therefore, the contact between the fluid flow and the plate is entirely or nearly entirely limited to the aft end of plate 46. This also causes plate 46 to swivel to its opposite stop position causing rotational reversal of the arm 42 and its fluid flow.

Figures 11, 12, 13:
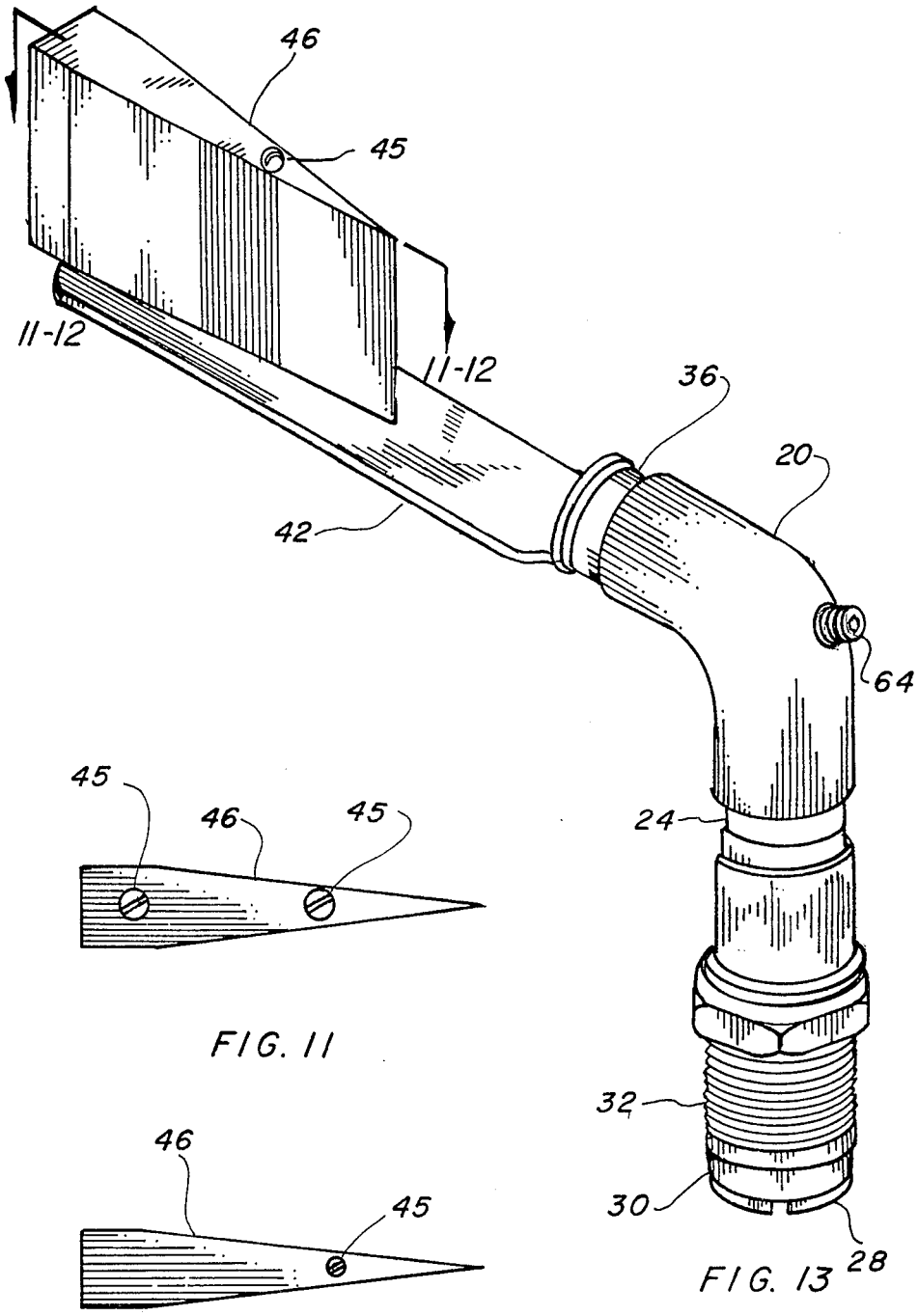
FIG. 11 is a plan view taken along lines 11—11 of FIG. 13.
FIG. 12 is a plan view taken along lines 12—12 of FIG. 13.
FIG. 13 is a partial isometric view of the second embodiment.

The second embodiment is much like the first except it is simplified. This embodiment is pictorially illustrated in FIGS. 11 through 13 and differs in that the torque plate 46 is fixed eliminating the need of plate stops 48 and since this is a non-reversing system, stop reversers 34 are also excluded. In this embodiment, the torque plate 46 is attached to the arm 42 with securing means 45 such as screws, rivet pins and the like, as shown in FIGS. 11 through 13. There may be one fastener or a plurality as illustrated in FIG. 11. The connection between the plate 46 and arm 42 may also include a slot in one of the holes for adjustment or if a screw is used this angular positioning may be accomplished singularly. As in the preferred embodiment, the arm 42 is an integral part of the nozzle 35 as shown in FIG. 13 or may be attached directly to the body 20 as illustrated in FIG. 9.

The nozzle means 36 is the same as the preferred embodiment including an optional separate orifice 40 and, contains a restrictor 64 as shown in FIG. 13. This second embodiment also contains a hollow straight connecting sleeve 24 and a hollow union 32, however, as stop reversers are not required this sleeve and union may be slightly shorter in length as no connecting surface is required.

In the operation of this non-reversing system, the fluid flow leaves the nozzle 36 and impacts on the plate 46 causing a change in fluid flow direction into the desired flow dispersal pattern as governed by the angle of the plate 46. Simultaneously, the momentum of the flowing fluid while changed in direction, is transmitted to the arm in the form of a dynamic force and as the body 20 is attached to the arm, it is free to rotate upon the connecting sleeve 24 within the union 32. This rotation continues as long as the fluid force is maintained. The application for this embodiment is where a continued rotational flow pattern is desired as in agricultural locations or large areas such as golf courses and the like. The simplified system is obviously cost effective as a number of components are eliminated and therefore is indicative of the basic concept of the use of a flat plate whose interaction with a fluid flow generates both rotational torque and desirable dispersal of the fluid flow.

Figures 14, 15, 16, 17, 18, 19:
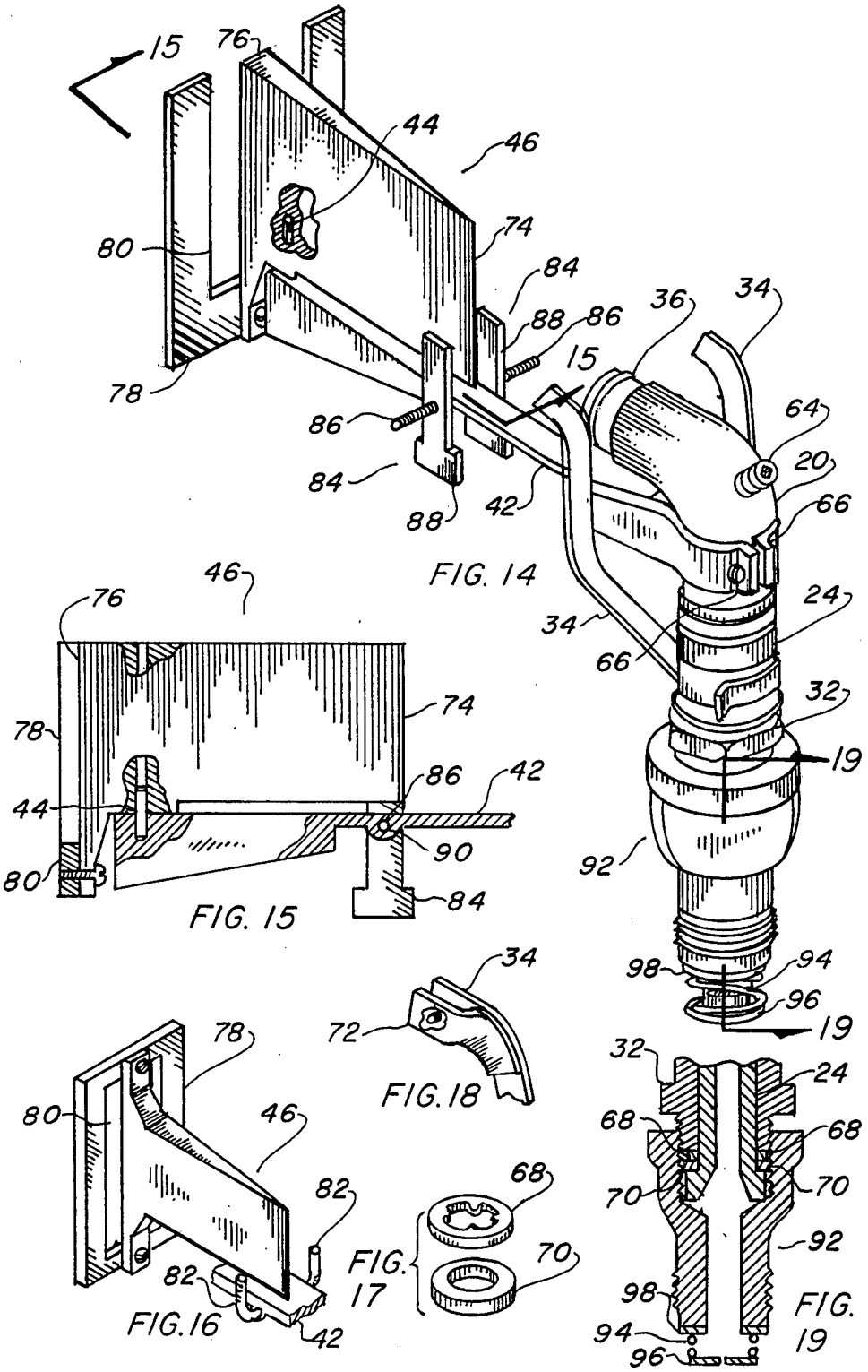
FIG. 14 is a partial isometric view of the third embodiment with the ballast plate attached to the torque plate and a spring loaded pressure regulator.
FIG. 15 is a cross sectional view taken along lines 15—15 of FIG. 14.
FIG. 16 is a partial isometric view of the torque plate with an enclosed ballast plate embodiment and a pair of fixed rods as means to limit the torque.
FIG. 17 is a exploded isometric view of the flanged retaining gasket completely removed from the invention for clarity.
FIG. 18 is a partial view of the directional shifter with an adjustable face completely removed from the invention for clarity.
FIG. 19 is a cross sectional view illustrating the pressure regulator and flanged retained gasket taken along lines 19—19 of FIG. 14.

The third embodiment is preferred but much like that of previous embodiments except the torque plate is distinct and the travel limiting means are uniquely different. This embodiment is pictorially illustrated in FIGS. 14 through 19 and consists of a body 20 similar to the preferred embodiment except for the omission of the flow restrictor 64. The nozzle means 36 is again the same as the other embodiments. The arm 42 differs in that it is affixed to the body 20 by the use of a split pair of opposed encompassing finger clamps 66 that surround the body 20 and are compressed together with threaded fasteners. While this arm 42 is illustrated in FIG. 14 and is incorporated in the third embodiment, it may be attached as shown in FIGS. 1 and 6 or integral as depicted in FIG. 13 with equal ease. The preferred embodiment of this arm 42 is integral with the body 20 in any case. The basic location is also the same and no separate pivoted member is utilized as in the second embodiment. The arm 42 preferably, but not necessarily, contains a greater mass at the extended end in a wedge shape as shown in FIG. 15 contributing to the balance of the system.

The third embodiment differs in respect to the gasket 30 retained by the flange 28 of the connecting sleeve 24 and compressed by the union 32 in that the gasket is in two separate parts. A first ring 68 has a low coefficient of friction and preferably a plurality of central aperture area spokes fitting around the connecting sleeve 24 and is contiguous with the union 32. The second ring 70, combined with the first, comprises the gasket 30 and is of a high coefficient of friction and thicker than the first. Other configurations may also be provided with the two rings having different aperture areas.

To maintain concentricity, the rings 68 and 70 may be bonded together with waterproof adhesive such as epoxy or the central aperture areas may be in the form of spokes contiguously engaging the sleeve 24 or further a combination of both. With very low pressure, the low coefficient of friction washer makes sole contact with union 32. As the pressure is increased sufficiently, the higher coefficient of friction washer being of a compressible material makes contact with the union 32. There is therefore a transition from a low coefficient of friction to higher coefficient of friction contact with union 32 as the supply pressured is increased. Therefore, if the pressure is doubled, the frictional load resistance is more than doubled. The rotational speed is therefore stabilized over a wide range of pressure. It will be apparent that even though in this specification the low coefficient washer and high coefficient washer have similar diameters that other diameterical combinations are possible. The rings 68 and 70 of the gasket are shown separately in FIG. 17 and assembled in FIG. 19.

The restrictor 64 is the same and may be eliminated without any impact on the invention as its use is not necessary for the function of a single fluid flow system but adds utility when a number of units are used in concert.

The adjustable reversers 34 are identical to the other embodiments except an adjustable plate 72 may be added on the end of the preferred embodiment that is constructively formed from metal sheet ribbon. This adjustment plate 72 portion is also made of metal sheet either of the same material or of a spring steel with higher tensile strength and a increased modulus of elasticity. In either case, the adjustment plate 72 is attached to the reverser 34 and an offset leg is distended distal-proximate thereunto with a threaded fastener such as a screw threadably retained in the parent reverser. The screw upon rotation changes the angle of the plate 72 under the influence of the spring characteristic of the metal allowing an adjustment to be made easily and retain its parallel relationship. The adjustable plate 72 attached to the reverser 34 is shown completely removed from the invention in FIG. 18 and as this is an optional feature FIG. 14 illustrates the reverser without this addition.

The means to disperse the flow of fluid from the nozzle 36 in this embodiment is basically the same utilizing a torque dispersal plate 46. This plate 46 however consists of an apex section with a sharp apex on one end 74 and a blunt section with blunt end 76 on the other. In between the two ends is a swivel axis created by the pivotal member 44 in the form of a rigid pin. A central location of the axis provides a butt section weight three times that of the apex section due to butt section width. To achieve a desirable situation, the distance between the sharp apex and the axis is increased to at least 71 percent of the length of the plate provided the butt section is made of a heavy dense material such as steel, brass, bronze, zinc, etc. while the apex is made of less dense material such as aluminum or thermoplastic. This approach ensures that the plate 46 will swivel through the neutral point where the fluid flow by the nozzle 36 is bifurcated by the apex of the plate because the kinetic energy is greater in the butt section compared to the apex section. Further this embodiment shortens the combined length of the plate 46 and the arm 42 while providing greater reliability of plate 46 travel limiting means.

A preferred method to increase the ratio of blunt end 76 moment of inertia to the apex end 74 moment of inertia is by the use of a ballast plate 78 shown in FIGS. 14–16. This ballast plate 78 is in a perpendicular relationship to the blunt end 76 of the torque plate 46 and contains an aperture 80 in alignment with each parallel side of the torque plate 46 permitting unrestricted fluid flow therethrough during rotational movement. Since mass and weight are added to the blunt end 76 the combination substantially increases the ratio of the blunt end moment of inertia to the apex end moment of inertia thereby permitting the location of the pivotal member 44 to be equal to or greater than 90 percent of the distance from the apex end 74 to the axis of the pivotal member 44 in relation to the total length of the plate 46. The addition of this ballast plate 78 allows the torque plate 46 to be fabricated of a light weight material, as previously discussed, while the ballast plate 78 is formed from a heavy dense material with the dissimilar materials being of little consequence since they are attached with conventional means such as threaded fasteners illustrated in FIGS. 14–16. The aperture 80 may be open ended as shown in FIG. 14 or completely enclosed as depicted in FIG. 16 with equal ease as long as unrestricted fluid flow is allowed.

The means to limit the travel of the torque plate 46 relative to the arm 42 may be accomplished by the use of a simple pair of fixed rods 82 oppositely disposed upon the arm 42 near the apex end 74 of the torque plate 46 providing an immutable restrictive relation between each side. These rods 82 are illustrated removed from the arm 42 but in the proper relative position in FIG. 16. The attachment of the rod 82 to the arm 42 may be by any means well known in the art such as pressed into holes in the arm that are slightly smaller creating a frictional press fit or by threading the ends of the rods 82 and utilizing a threaded hole. As these methods are conventional, the actual attachment is not necessary to be illustrated in the drawings other than the relationship of FIG. 16. It will be necessary to form these rods 82 into a right angular disposition, however as a vertical leg is necessary to be contiguous with the plate 46.

The preferred method to limit the travel of the torque plate 46 is by the use of a pair of adjustable pendulums 84 swively and oppositely disposed upon the arm 42 allowing the restrictive relationship to be manually altered controlling the acute angle of travel of the torque plate 46. This configuration consists of a straight threaded rod 86 with relatively fine threads on the outside surface. This threaded rod 86 is attached to the arm 42 by any well known method such as a threaded hole illustrated in FIG. 15. Other acceptable methods may be brazing or soldering to the bottom of the arm, upsetting fingers on the middle of the rod and pressing into a clearance hole for the threads or a friction plate screwed to the bottom of the arm 42.

If a friction plate is used, the threaded hole may be half in the arm 42 and half in the plate with a slight gap between the elements. The threaded rod 86 may be secured by tightening the screws thereby compressing each side of the threads.

The individual pendulum 88 as illustrated in FIGS. 14, 15 may be exactly rectangular in shape or have the lower end slightly wider as depicted in FIG. 15. In any event, the ratio of the distance from the upper end to the threaded hole 90 in the center portion to the lower end with respect to the pendulum axis is in the order of five to eight. This produces a quasi so called "Schuler Pendulum" whose vertical orientation will be practically independent of acceleration. The individual pendulum 88 does not therefore require friction methods to perpetuate its position on the threaded rod 86 while allowing adjustment to be easily and readily made by simply rotating the pendulum 88 in the desired direction. The adjustment in the pendulum 84 allows the fan like pattern of the fluid flow to be uniformly changed in its dispersion flowpath.

In this embodiment a pressure regulator 92 may be added to the fluid flow system. This regulator 92 contains a spring 94 attached to a restrictor plug 96 with a centrally located orifice sensitive to fluid flow. In operation, the plug 96 is urged into restriction by the flow of fluid against the resistance of the spring 94 except for controlled passage through the orifice and the spring flues. A gasket 98 is bonded to the spring 94 by compressive fitting or water proof epoxy bonding as in the gasket to the body 100. This allows the entire regulator 92 to be removed or easily changed to other systems as the plug 96 is similarly attached to the spring 94. The use of this device permits automatic equalization of fluid flow through a plurality of systems. By the use of different springs 94 or gaskets 98, the point of regulation may be altered as the resilience of the spring or gasket has a direct relationship of the set point.

While the basic elements in the invention remain unchanged in the previously discussed embodiment, some results have been affected by the third embodiment. As before when a confined beam strikes a flat surface at a small acute angle the distribution is highly correlated with the fact that the area of a circle or a sector of a circle varies as the square of the radius. Thus, the ideal disposition of the surface fluid between $\frac{1}{2}$ maximum range and maximum range is three times that between zero range and $\frac{1}{2}$ maximum range. Overlap coverage requirements are therefore radically reduced. This embodiment allows ease of adjustment of the travel of the torque plate 46 with the pendulum automatically maintaining the adjustment. Further the variable coefficient washer arrangement allows rotational speeds to be stabilized over a large variation of external pressures and the adjustable reverser 34 adds control of the reversal function. Finally the addition of the pressure regulator 92 automatically equalizes flow among several systems used in concert.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the claims. In particular it will be noted that the generic common denominator in all embodiments of this invention is the use of a simple plate to generate steady rotational motivation of a concentrated fluid flow source and desirable transformation of concentrated fluid flow into a desirable vertical or nearly vertical fan pattern.

I claim:

1. A fluid flow system for dispersing a flow of fluid comprising:

(a) an angular body having an inlet and outlet end with an internal passageway therethrough and connection means on the inlet and outlet end for transmitting fluid within, (b) a hollow straight connecting sleeve with connecting means on one end and a flange having a gasket on the other end, said sleeve connected to the inlet end of said body for extending the body creating a straight tubular section between the body and the flange, (c) a hollow union having a means of attachment on the outside of one end and a plurality of grooves on the other end with flats therebetween rotatably retained upon said sleeve straight tubular section allowing rotation thereupon while maintaining a hydraulic seal between said flange retained gasket and the attachment end of said union, (d) nozzle means having a longitudinal axis defining an orifice through which said fluid passes in a controlled configuration, (e) an arm angularly projecting from said body having an upwardly extending pivotal member aligned parallel with the axis of said nozzle means, (f) a torque dispersal plate having a fore end and an aft end disposed upon said pivotal member, said fore end in front of said member and said aft end therebehind said plate intercepting said fluid flow, so as to change the flow direction and disperse the fluid into a fan-like pattern, also generating arm turning torque, (g) plate stop means joined to said arm for limiting the swivel travel of said torque dispersal plate attached upon said pivotal member within fixed limits, when said flow of fluid leaves said nozzle means it first impacts upon the for end of said plate and also the aft end causing swivel torque about the axis of said pivotal member simultaneously, a lesser torque occurs in the aft section; as a result, said plate is driven by said swivel torque into pressure contact with said plate stop means, and (h) a pair of adjustable reversers having adjustable plates intimately embracing the grooves on said union and projecting outwardly distal to the outlet end of said body tangentially aligned therewith for confining the rotational movement of the body in relation to said union, physically stopping arm rotation created by arm turning torque, causing said plate to swivel to its opposite plate stop, due to kinetic energy stored in its aft section exceeding that stored in its fore section, with swivel action reversing said arm and fluid flow rotation, a further reversal force is also provided as the adjustable reverser protrudes into said fluid flow changing momentarily the angle of the flow out of the nozzle means so that fluid impact at the fore end of plate is largely shifted to the aft end of the plate causing the plate to swivel to its opposite stop whereupon arm and fluid flow rotation reverses.

2. The invention as recited in claim 1 wherein said adjustable reversers further comprise:

a metallic sheet ribbon shape having a retaining loop on one end and an angular flange on the other, the loop intimately embracing said groove of said union in an adjustable manner.

3. The invention as recited in claim 1 wherein said nozzle means further comprises:

a separate orifice having a specific internal shape disposed within said nozzle means for creating a fluid flow field of a specific vertical flow pattern.

4. The invention as recited in claim 1 wherein said torque dispersal plate further comprises:

a roughened surface on each side parallel to said pivotal member for creating a backward shift of fluid flow thereupon increasing the amount of fluid flow impact on the fore end of said plate.

5. The invention as recited in claim 1 wherein said torque dispersal plate further comprises:

at least one end of the plate with respect to its interface with the pivotal member has a greater mass than the other end.

6. The invention as recited in claim 1 wherein said torque dispersal plate further comprises:

at least one end of the plate with respect to its interface where the pivotal member has a greater length than the other end.

7. The invention as recited in claim 1 wherein said torque dispersal plate further comprises:

at least a portion of said aft end flared wider to produce an increased amount of aft torque.

8. The invention as recited in claim 1 wherein said plate stop means further comprises:

a stop mounted upon said arm in between said arm and said pivotal member contiguously engaging the plate limiting rotation thereof.

9. The invention as recited in claim 1 wherein said arm further comprises:

two pieces adjustably connected together allowing angular alignment thereof.

10. The invention as recited in claim 1 further comprising:

a restrictor adjustably secured within said body for limiting the amount of fluid flow within the body when said system is used in concert allowing a plurality of systems to be balanced in respect to a line loss of flow when connected therebetween.

11. The invention as recited in claim 1 wherein said nozzle means further comprises:

a first and a second end with attaching means on the first end and an opening therethrough joined to said body on the second end defining an orifice through which said fluid passes.

12. The invention as recited in claim 1 wherein said nozzle means further comprises:

a portion of the outlet end of said angular body defining an orifice through which said fluid passes.

13. The invention as recited in claim 7 wherein said arm further comprises:

a permanent connection integral with said nozzle means.

14. The invention as recited in claim 7 wherein said arm further comprises:

a permanent connection to the outlet end of said body in such a manner as to maintain parallel alignment with said nozzle.

15. The invention as recited in claim 1 wherein said arm is connected by an attaching means to said connecting sleeve.

16. A fluid flow system for dispersing a flow of fluid comprising:

(a) an angular body having an inlet and outlet end with an internal passageway therethrough and connection means on the inlet and outlet end for transmitting fluid within, (b) a hollow straight connecting sleeve with connecting means on one end and a flange having a gasket on the other end, said sleeve connected to the inlet end of said body for extending the body creating a straight tubular section between the body and the flange, (c) a hollow union having means of attachment on the outside of one end and a plurality of grooves on the other end with flats therebetween rotatably retained upon said sleeve straight tubular section allowing rotation thereupon while maintaining a hydraulic seal between said flange retained gasket and the attachment end of said union, (d) nozzle means having a longitudinal axis defining an orifice through which said fluid passes in a controlled configurartion, (e) an arm angularly projecting from said body having an upwardly extending pivotal member aligned perpendicular to the axis of said nozzle means, (f) a torque dispersal plate having a fore end and an aft end disposed upon said pivotal member, said fore end in front of said member and said aft end therebehind said plate intercepting said fluid flow, so as to change the flow direction and disperse the fluid into fan-like pattern, also generating arm turning torque, (g) plate stop means joined to said arm for limiting the swivel travel of said torque dispersal plate attached upon said pivotal member within fixed limits, when said flow of fluid leaves said nozzle means it first impacts upon the fore end of said plate and also the aft end causing swivel torque about the axis of said pivotal member simultaneously, a lesser torque occurs in the aft section; as a result, said plate is driven by said swivel torque into pressure contact with said plate stop means, further having a sliding adjustable frictional clamp engaging two sides of said arm creating an interference with the movement of said plate stop means limiting the swivel of the plate, and (h) a pair of adjustable reversers having adjustable plates intimately embracing the grooves on said union and projecting outwardly distal to the outlet end of said body tangentially aligned therewith for confining the rotational movement of the body in relation to said union, physically stopping arm rotation by arm turning torque, causing said plate to swivel to its opposite plate stop, due to kinetic energy stored in its aft section exceeding that stored in its fore section, with swivel action reversing said arm turning torque and direction of said arm and fluid flow rotation, a further reversal force is also provided as the adjustable reversers protrudes into said fluid flow changing momentarily the angel of the flow out of the nozzle means so that fluid impact at the fore end of plate is largely shifted to the aft end of the plate causing the plate to swivel to its opposite stop whereupon arm and fluid flow rotation reverses.

17. A fluid flow system for dispersing a flow of fluid comprising:

(a) an angular body having an inlet and outlet end with an internal passageway therethrough and connection means on the inlet and outlet end for transmitting fluid within, (b) a hollow straight connecting sleeve with connecting means on one end and a flange having a gasket on the other end, said sleeve connected to the inlet end of said body for extending the body creating a straight tubular section between the body and the flange, (c) a hollow union having means of attachment on the outside of one end and a plurality of grooves on the other end with flats therebetween rotatably retained upon said sleeve straight tubular section allowing rotation thereupon while maintaining a hydraulic seal between said flange retained gasket and the attachment end of said union, (d) nozzle means having a longitudinal axis defining an orifice through which said fluid passes in a controlled configuration, (e) an arm angularly projecting from said body having an upwardly extending pivotal member aligned perpendicular to the axis of said nozzle means, (f) a torque dispersal plate having a fore end and an aft end disposed upon said pivotal member, said fore end in front of said member and said aft end therebehind said plate intercepting said fluid flow, so as to change the flow direction and disperse the fluid into a fan-like pattern, also generating arm turning torque, (g) plate stop means joined to said arm for limiting the swivel travel of said torque dispersal plate attached upon said pivotal member within fixed limits, when said flow of fluid leaves said nozzle means it first impacts upon the fore end of said plate and also the aft end causing swivel torque about the axis of said pivotal member simultaneously, a lesser torque occurs in the aft section; as a result, said plate is driven by said swivel torque into pressure contact with said plate stop means, (h) a pair of adjustable reversers having adjustable plates intimately embracing the grooves on said union and projecting outwardly distal to the outlet end of said body tangentially aligned therewith for confining the rotational movement of the body in relation to said union, physically stopping arm rotation by arm turning torque, causing said plate to swivel to its opposite plate stop, due to kinetic energy stored in its aft section exceeding that stored in its fore section, with swivel action reversing said arm turning torque and direction of said arm and fluid flow rotation, a further reversal force is also provided as the adjustable reverser protrudes into said fluid flow changing momentarily the angel of the flow out of the nozzle means so that fluid impact at the fore end of plate is largely shifted to the aft end of the plate causing the plate to swivel to its opposite stop whereupon arm and fluid flow rotation reverses, and (i) tension means yieldably attached from said torque plate to said arm to prevent undesirable oscillations about said pivotal member and to position said torque plate in the middle of said arm when said fluid flow is not present, and to provide torque plate stop means.

18. A fluid flow system for dispensing a flow of fluid comprising:

(a) a body for transmitting fluid within, (b) means to rotatably connect the body to structure connecting said fluid flow, for attachment therewith, (c) nozzle means joined to said body defining an orifice through which fluid passes, (d) arm extension means rigidably disposed in parallel alignment with said nozzle means providing a mounting surface remote from said nozzle, said arm affixed to and angularly projecting from said body means, (e) means to disperse the flow of fluid from said nozzle means attached rotatably upon said arm extension means defining a torque plate with a sharp apex on one end and a blunt end on the other having an axis of rotation vertical to the flow of fluid from said nozzle means with the sharp end closer to the nozzle means than the blunt end the moment of inertia of the blunt end exceeding that of the apex end about the swivel axis said torque plate characterizing a surface upon which said fluid impinges after leaving said nozzle means interrupting the fluid flow so as to uniformally change flow direction dispersing the fluid into a fan-like pattern along with generating turning torque, said torque plate rotatably disposed upon said arm dispensing means such that the plate is free to rotate thereupon with said sharp end intercepting said fluid flow causing a change in flow direction, said plate dispersing the fluid into a fan-like pattern, (f) means to limit the travel of said torque plate to an acute angle of less than 45-degrees defined by a restriction on each side of said arm extensions means contiguously engaging the sharp end of the torgue plate when said flow of fluid impacts thereupon, (g) a pair of adjustable reversers intimately embracing said rotatably connecting means and projecting outwardly distal to the outlet end of said body tangentially aligned therewith for confining rotational movement of said body means, and (h) a pair of adjustable pendulums swivelly and oppositely disposed upon the arm extension means allowing the restrictive relationship therebetween to be manually changed controlling the acute angle of travel of the torque plate.

19. A fluid flow system for dispensing a flow of fluid comprising:

(a) a body for transmitting fluid within, (b) means to rotatably connect the body to structure connecting said fluid flow, for attachment therewith, (c) nozzle means joined to said body defining an orifice through which fluid passes, (d) arm extension means rigidably disposed in parallel alignment with the axis of said nozzle means providing a mounting surface remote from said nozzle means, and (e) means to disperse the flow of fluid from said nozzle means attached rotatably upon said arm extension means defining a torque plate with a sharp apex on one end and a blunt end on the other having an axis of rotation vertical to the flow of fluid from said nozzle means with the sharp end closer to the nozzle means than the blunt end the moment of inertia of the blunt end exceeding that of the apex end about the swivel axis said torque plate characterizing a surface upon which said fluid impinges after leaving said nozzle means interrupting the fluid flow so as to uniformally change flow direction dispersing the fluid into a fan-like pattern along with generating turning torque, said torque plate thereof having a ballast plate joined to said blunt end to increase the blunt end mass, the ballast plate further having an aperture in alignment with each parallel side of the torque plate permitting unrestricted fluid flow therethrough during rotational movement; said ballast plate permitting a blunt end moment of inertia significantly larger than the apex end moment of inertia while at the same time permitting the apex end to be substantially longer than the blunt end, said unrestricted fluid flow through said aperture during said rotational movement being converted to an obstructed fluid flow with the said ballast plate when the fluid flow impinges upon said adjustable reversers; said obstructed flow causing said torque plate to swivel to an opposite torque plate stop.

* * * * *